United States Patent [19]

Pon-Tzu

[11] Patent Number: 4,760,651

[45] Date of Patent: Aug. 2, 1988

[54] AIR-VENTILATING SHOE PAD HAVING SHOE-LIFT EFFECT

[76] Inventor: Chi Pon-Tzu, 3F, No. 8-2, 411 Lane An-Ching St., San-Chung City, Taiwan

[21] Appl. No.: 8,530

[22] Filed: Jan. 29, 1987

[51] Int. Cl.[4] ..... A43B 7/06; A43B 13/38; A43B 11/00

[52] U.S. Cl. ..... 36/3 B; 36/44; 36/138; 128/582; 128/588

[58] Field of Search ..... 128/582, 588; 36/3 B, 36/3 R, 43, 44, 29

[56] References Cited

U.S. PATENT DOCUMENTS

| | | | |
|---|---|---|---|
| 3,097,438 | 7/1963 | Evans | 36/138 X |
| 3,180,039 | 4/1965 | Burns, Jr. | 36/3 B |
| 4,215,492 | 8/1980 | Sandmeier | 36/3 B |
| 4,602,441 | 7/1980 | El Sakkaf | 36/3 R |

FOREIGN PATENT DOCUMENTS

| | | | |
|---|---|---|---|
| 594172 | 6/1925 | France | 36/3 B |
| 826665 | 1/1938 | France | 36/3 R |
| 1155947 | 12/1957 | France | 36/3 B |
| 2165439 | 4/1986 | United Kingdom | 36/3 B |

*Primary Examiner*—James Kee Chi

[57] ABSTRACT

A shoe pad includes an air-blowing compression chamber provided in the central space, a protruding tongue plate provided on the end portion of the pad to serve as a shoe-lift and plural concave slots or guide holes formed in the protruding tongue plate for circulating air passages, so that the shoe pad may be put into any shoe to enforce the air circulation in a shoe.

2 Claims, 2 Drawing Sheets

AIR-VENTILATING SHOE PAD HAVING SHOE-LIFT EFFECT

BACKGROUND OF THE INVENTION

To let air circulating in a shoe is a very good concept. However, all current wellknown air ventilation devices used in a shoe highlight that an air-blowing mechanism is mounted in the heel. For instance, a conventional "Fresh Air shoe" must be enlarged to obtain a bigger space to facilitate the air circulation inside the shoe to thereby make its appearance so awkward. Furthermore, the shoe heel after being formed with an empty interior to fix such an air-blowing mechanism, the service life of the shoe may be shortened and the bottom of the heel may easily cause air leakage to thereby lose its air-blowing function.

The present inventor has found the defects of such a conventional shoe and invented the present air-ventilating shoe pad.

SUMMARY OF THE INVENTION

The object of the present invention is to provide a shoe pad including an air-blowing compression chamber provided in the central space, a protruding tongue plate provided on the end portion of the shoe pad to serve as a shoe-lift and plural concave slots or guide holes formed in the protruding tongue plate for passages of the circulating air, so that the shoe pad may be put into any shoe to enforce the air circulation in a shoe.

Accordingly, the object of the present invention is to provide a shoe pad having the following functions:

1. To promote the air circulation in the shoe;
2. To provide a pad with proper size adapted to snugly fix into various types of shoes;
3. To direct air into the shoe from environmental fresh air source; and
4. To help a shoe wearer smoothly wear a shoe by the "shoe-lift" formed in situ in the shoe.

BRIEF DESCRIPTION OF THE DRAWINGS

FIG. 7 is a perspective view showing an application of the present invention.

DETAILED DESCRIPTION OF THE INVENTION

Figures 1, 3:
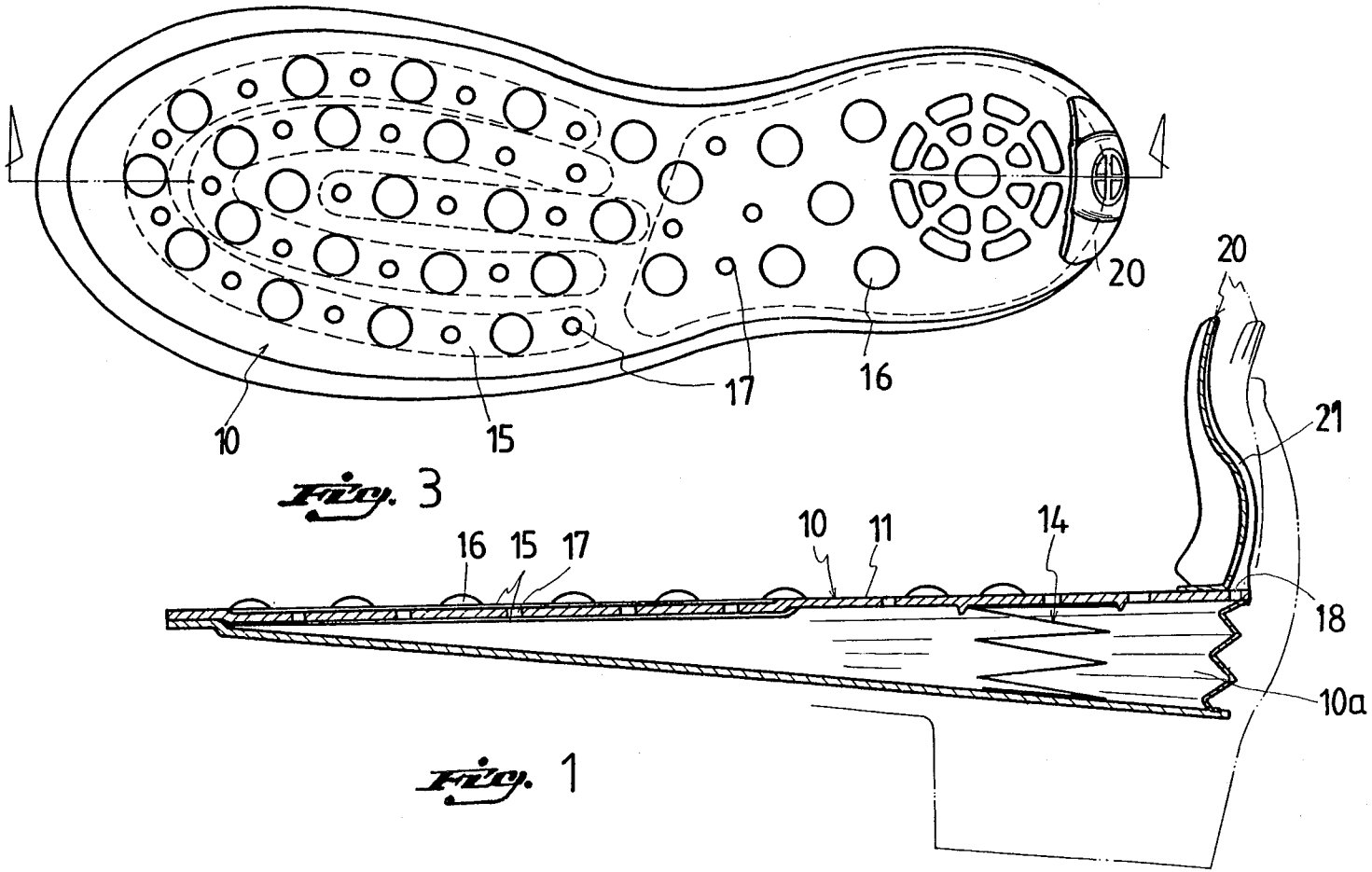
FIG. 1 is a side cross sectional view of the present invention
FIG. 3 is a top view of the present invention.

FIG. 1 is a side sectional view of the present invention, in which shoe pad(10) is an oblique wedge-shaped pocket body comprising an upper and a lower pad plates(11,12) and a pleated elastic side wall 13 circumferentially disposed between the two plates 11, 12, a bugle-shaped spring(14) (or plate spring or other elastic device) which maybe added between the upper and lower pad plates(11,12) to help the air chamber ( also called air-blowing chamber(**10*a*)) in the pocket body of the shoe pad after being compressed. All these items belong to the structure of the most basic form of the present invention. The compression resulted from the stepping and treading by the wearer's foot makes the air-blowing chamber (10*a***) squeezing the air outwardly to cause the air flowing in the shoe and the shoe opening to inhale and exhale the air like a man's breathing.

Figure 4:
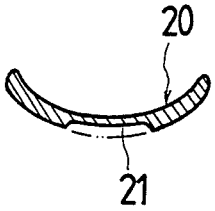
FIG. 4 is example 1 of the cross seetional view of the tongue plate of the present invention.
Figure 5:
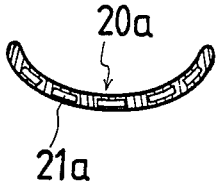
FIG. 5 is example 2 of the cross sectional view of the tongue plate of the present invention.

At the heel of the shoe pad(10) disclosed in FIG. 1, a tongue plate 20 extends upwardly from the rear portion of the pad 10. The shoe, the lateral cross section of the tongue plate(20) is shown in FIG. 4, its back portion is formed with plural concave slots(21) extending on the surface of the shoe pad communicated with the air-blowing chamber. Also in the lateral cross section of tongue plate(**20*a*) as shown in FIG. 5, plural air circulating passages(21*a***) are provided to direct the air at the shoe opening into the air-blowing chamber. Features of the functions of said tongue plate can serve as the general air passage and also serve as a shoe-life to guide the shoe to be fitted into a wearer's foot.

Figure 2:
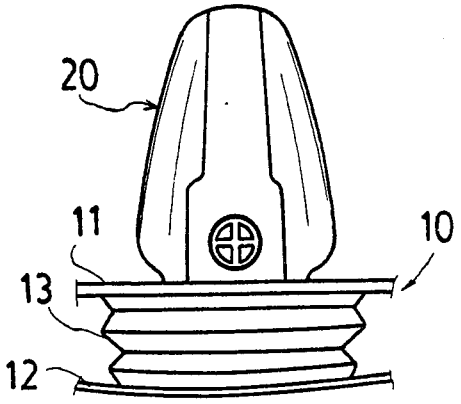
FIG. 2 is a back view of the present invention.

FIG. 2 shows a back view of the shoe pad of which a broad rim is formed along the contour of the upper and lower plates 11, 12 which can be cut to snugly fit each shoe pad into various differently-sized shoes.

FIG. 3 is a top view of the present invention, in which the dotted lines show plural guide slots 15 each slightly concave downwardly from the upper plate 11 to serve as passage of the air circulating in the chamber **10*a*. Plural air bents 17 each formed as a small round hole are formed through the upper plate 11 and defined in the guide slots 15. The convex grains 16** as shown in the larger circles may serve for massage purpose and may make space between a wearer's foot bottom and the pad for air flowing through the air vents.

Figure 6:
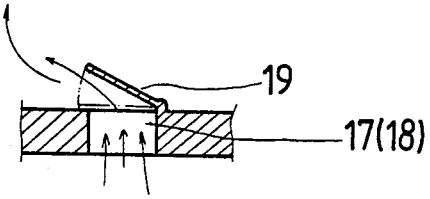
FIG. 6 is an exclusive view of the structure of the unidirectional valve blade of the air circulation port and passage of the present invention.

The air vent(17) and the ports(18) of the air passage(21) in the aforesaid shoe pad can be provided with an unidirectional valve blade during their forming. As shown in FIG. 6, the upper pad plate(11) is formed by plastic injection or vacuum forming with the air vents 17 or port 18, an oblique valve blade(19) is extruded according to the size of the round hole of the vent or port as shown in FIG. 6 such that the valve blade may be formed as an oval form with its minor axis equal to the diameter of the round hole, and its major axis larger than the diameter of the round hole to allow the valve blade covering the air vent or port and to allow the single directional air flow from one side to the other side, and vice versa. If the upward facing valve blades are provided in the air circulation ports of the upper pad plate and the downward(inward) facing valve blades are provided in the air circulation ports under the tongue plate and upon the wearer's stepping or treading, the air in the chamber **10*a* will be blown upwardly through the vents 17 as closing the port 18 of the tongue plate 20. Alternatively, upon the lifting of a wearer's foot, the valve of tongue port 18 will be opened to suck air from an upper opening and the valve of the vents 17** will be closed.

I claim:

1. A shoe pad adapted to fit in a shoe comprising:

an upper plate having air vents formed therethrough, a lower plate and a pleated side wall circumferentially disposed between said upper and lower plates, defining an oblique wedge-shaped pocket body serving as an air-blowing chamber;

a spring added between said upper and lower plates;

a tongue plate protruding on a rear end portion of said upper plate; and plural guide slots each concave downwardly from said upper plate serving as passages of the air circulating in said air-blowing chamber and each said air vent of said upper plate formed in said guide slot, the improvement which comprises:

said tongue plate formed on the rear portion of said upper plate having plural concave slots longitudinally formed on the back portion of said tongue plate communicated with said air-blowing chamber, said tongue plate formed as a shoe-lift for helping the wearing of said shoe.

2. A shoe pad according to claim 1, wherein said tongue plate is formed with plural air circulating passages therein adapted to direct air from shoe opening into said air-blowing chamber of said shoe pad.

* * * * *